US008978283B2

(12) United States Patent
Brunner et al.

(10) Patent No.: US 8,978,283 B2
(45) Date of Patent: Mar. 17, 2015

(54) STRIKING PIN SAFETY ELEMENT

(71) Applicant: Rheinmetall Air Defence AG, Zurich (CH)

(72) Inventors: Dominic Brunner, Sissach (CH); Michael Gerber, Zurich (CH); Roman Widmer, Zurich (CH)

(73) Assignee: Rheinmetall Air Defence AG, Zurich (CH)

( * ) Notice: Subject to any disclaimer, the term of this patent is extended or adjusted under 35 U.S.C. 154(b) by 0 days.

(21) Appl. No.: 14/101,037

(22) Filed: Dec. 9, 2013

(65) Prior Publication Data

US 2014/0144057 A1 May 29, 2014

Related U.S. Application Data

(63) Continuation of application No. PCT/EP2012/060495, filed on Jun. 4, 2012.

(30) Foreign Application Priority Data

Jun. 7, 2011 (DE) ..... 10 2011 106 200

(51) Int. Cl.
*F41A 17/00* (2006.01)
*F41A 17/06* (2006.01)
*F41A 17/64* (2006.01)

(52) U.S. Cl.
CPC ..... *F41A 17/063* (2013.01); *F41A 17/06* (2013.01); *F41A 17/64* (2013.01)
USPC ..... 42/70.08; 42/70.05; 89/27.12; 89/142; 89/148

(58) Field of Classification Search
USPC ..... 42/70.08, 27.12, 28.1, 70.05; 89/142, 89/148, 27.12
See application file for complete search history.

(56) References Cited

U.S. PATENT DOCUMENTS

| | | | | |
|---|---|---|---|---|
| 5,022,175 | A | 6/1991 | Oncke et al. | |
| 6,145,234 | A * | 11/2000 | Fluhr | 42/70.08 |
| 6,442,880 | B1 * | 9/2002 | Allan | 42/70.08 |
| 8,042,450 | B2 | 10/2011 | Doll et al. | |
| 2012/0180357 | A1 | 7/2012 | Dietel et al. | |

FOREIGN PATENT DOCUMENTS

| | | | |
|---|---|---|---|
| DE | 19 46 831 | A | 3/1971 |
| DE | 90 01 066 | U1 | 4/1990 |
| DE | 102 15 910 | B4 | 4/2004 |
| DE | 10 2008 025 499 | A1 | 4/2009 |
| DE | 10 2008 009827 | A1 | 4/2009 |
| DE | 10 2006 037 306 | B4 | 12/2009 |
| DE | 10 2009 011 939 | A | 9/2010 |
| WO | WO 2010/145671 | A1 | 12/2010 |

* cited by examiner

*Primary Examiner* — J. Woodow Eldred
(74) *Attorney, Agent, or Firm* — Muncy, Geissler, Olds & Lowe, P.C.

(57) ABSTRACT

A remote-operable firing pin safety catch is provided. A mechanical firing pin safety catch is supplemented by a further electrically remote-operable safety catch device, wherein it is basically the case that firing is possible only when the safety catch of a firing pin has been both locally mechanically released and also electrically released by means of a remote controller. As an electrical firing pin safety catch, an electric actuator is incorporated into the mechanical firing pin safety catch.

18 Claims, 4 Drawing Sheets

STRIKING PIN SAFETY ELEMENT

This nonprovisional application is a continuation of International Application No. PCT/EP2012/060495, which was filed on Jun. 4, 2012, and which claims priority to German Patent Application No. DE 10 2011 106 200.2, which was filed in Germany on Jun. 7, 2011, and which are both herein incorporated by reference.

BACKGROUND OF THE INVENTION

1. Field of the Invention

The invention relates to a remote-operable firing pin safety catch. Here, a mechanical firing pin safety catch is supplemented by a further electrically remote-operable safety catch device, wherein it is basically the case that firing is possible only when the safety catch of the firing pin has been both locally mechanically released and also electrically released by a remote controller. As an electrical firing pin safety catch, an electric actuator is incorporated into the mechanical firing pin safety catch.

2. Description of the Background Art

For the ignition of the ammunition in barreled weapons, use is often made of mechanically actuated firing pins. Said firing pins are braced counter to a tension spring, and are released for firing, wherein the firing pin protrudes into the loading chamber of the barreled weapon. Upon the transfer of the kinetic energy of the firing pin to the ammunition situated therein, the ignition charge thereof is ignited. The firing pin is subsequently returned to a safe position by a restoring spring.

When the barreled weapon is loaded, a cartridge ready for firing is situated in the cartridge chamber in front of the firing pin. The weapon is thus in a critical state, and the safety catch of the weapon must be engaged to prevent inadvertent or accidental firing.

Mechanical firing pin safety catches are fundamentally known for this purpose. Weapons with mechanical ignition conventionally have a safety catch element which mechanically locks the final actuator (that is to say the firing pin). Said firing pin safety catch is normally operated manually, locally at the gun, by an operator. Here, a push-twist handle conventionally controls a Bowden cable which moves a piston rod, to the end of which is fastened a firing pin safety catch, whereby the firing pin safety catch either engages or releases.

For unmanned guns, this type of safety catch is normally not feasible, because either an operator is not available at all or else a relatively large amount of time and/or logistical expenditure is necessary to carry out the manual safety catch release.

A purely remote-operated firing pin safety catch for remote-operable guns is not desirable, and has the disadvantage that it could be released from a weapon control unit situated remote from the weapon when personnel are working on the weapon/gun, which would pose a risk to those personnel. Here, owing to the safety doctrine in effect, a range of functions on the gun can be carried out only when the gun is in a safety catch-engaged state; such functions include for example loading, unloading or set-up inspection.

DE 10 2006 037 306 B4 discloses a device for releasing a firing pin. The safety catch is realized by a transverse bar in the breech, which transverse bar holds the firing pin in a braced position. Said transverse bar is engaged into by a locking pin which is pushed away by said transverse bar when the breech is functionally connected to the weapon barrel.

DE 90 01 066 U1, which corresponds to U.S. Pat. No. 5,022,175, relates to a safety device for selective safety catch engagement of a firearm, in this case a revolver. Upon the bracing of a firing pin, a main spring rod is moved slidingly counter to the action of a spring. The firing pin is then blocked and held under the stress of the spring. If the trigger is actuated, the rod is released, wherein the firing pin itself is pivoted in an opposite direction to the rod movement and impacts against the cartridges. Said revolver has, as a first safety catch, a mechanical blocking mechanism which prevents locking of the firing pin such that the latter can no longer be pulled back before firing. A further, second safety device which is independent of the first safety device comprises substantially a control unit, an electronic decoder and an electronic driver stage. The control unit is formed by a block which realizes bracing or non-bracing of the firing pin. Incorporated in the block there is, inter alia, a motor which drives a drive pinion and a toothed wheel. The toothed wheel moves a disk which opens up a space for the rod to enter into in order to brace the firing pin. If bracing is to be prevented, said space is closed. The enabling of the control unit is possible only with knowledge of a code which can be input via a keyboard of a separate operating means which can be connected to the block. The intention of this is to prevent unauthorized use of the revolver.

DE 19 46 831 A discloses a safety catch device for force-actuated firing devices having a firing element. Here, a firing element of said type—firing pin—is fixed in a braced position and secured against inadvertent release. For further mechanical locking of the pawl which can be moved into its blocking position by the bracing movement of the firing element, said pawl can selectively be placed into an active position, in which it transmits the bracing movement, and an inactive position, in which it neutralizes the bracing movement. Said setting is carried out by means of a movable coupling member, the coupling surface of which engages, in the active position, on the pawl. The coupling member is arranged in the region of the rear end of the firing element and is in the form of a slide which is movable transversely with respect to the pivot axis of the pawl.

DE 10 2009 011 939 A is concerned with a safety catch device for a breech, wherein the breech or breech support is engaged over, and thereby locked, by a wedge-like block which is displaceable vertically with respect to the breech. The firing pin or ignition triggering is realized by means of a kinematic mechanism. Here, the kinematic mechanism combines two mechanical interacting safety catches. The kinematic mechanism comprises a first lever which is mounted in the manner of a rocker about an axis of rotation and which acts with a further, second lever on the firing pin. The second safety catch is realized by virtue of the ignition needle assembly being engaged over, as a safety catch parallel to the first safety catch, by a further lever. Said lever interacts with the first safety catch, for which purpose a movable means is incorporated which functionally connects the lever to the first safety catch.

DE 10 2008 025 499 A1 relates to a remote-controlled operating means for automatic weapons and machine guns. Here, an adaptable magnet carrier frame is incorporated on the rear end or on the base piece of the weapon, preferably instead of the shoulder support of a machine gun, and a trigger magnet and a safety catch magnet are ideally suspended in said magnet carrier frame. The two magnets ensure that the safe operating state is assumed in the event of a fault. Furthermore, entry into the operation sequence must be prevented if there is a fault. For this purpose, as a safety catch magnet, a known linear-movement/holding magnet is replaced with a linear-movement/holding magnet with a redundant hold coil. Upon the first occurrence of a fault, firing is suspended or prevented in order to maintain the operation sequence, or to forbid the initiation thereof. Furthermore, as a trigger magnet, the previous stroke magnet is replaced with a reversing stroke magnet, thus permitting single-shot firing and rapid single-shot firing. Said measure is intended to allow the weapon to be converted from handheld operation to remote-controlled operation and utilized correspondingly.

DE 102 15 910 B discloses a device for increasing safety during the operation and firing of a heavy machine gun or similar weapon, in particular on a carriage. Said device comprises a firing device an adjusting element and a manual emergency actuation means which can fire the weapon by means of an actuation cable without external power. A further adjusting element which is operated with external power is mounted on the rear end of the weapon. Said element, as a single-shot switch, can, by means of a lever mechanism, arrest and secure or else release and unlock the breech in the rearmost return position opposite the barrel. As a result, undesired triggering of firing occurs in the event of a defect of the firing pin arresting means.

SUMMARY OF THE INVENTION

It is the object of the invention to specify a firing pin safety catch which can be used for an in particular unmanned gun.

In an embodiment a mechanical firing pin safety catch is supplemented by a further, electrically remote-operable safety catch device, wherein it is basically the case that firing is possible only when the firing pin has been both locally mechanically released and also electrically released by means of the remote controller. Here, both safety catches are functionally linked to one another, that is to say the mechanical safety catch and the remote-controlled electrical safety catch are structurally interwoven with one another and form a unit. The weapon is placed into a "safety catch released" state—that is to say ready for firing with the firing pin released—only when the safety catch of the weapon has been both released by remote control and also mechanically released at the gun. To release the safety catch of the weapon, the sequence of the two (partial) safety catch release processes is arbitrary.

For this purpose, it is for example the case that a known Bowden cable of the mechanical safety catch release means is lengthened in a guide rod which has a U-shaped bulged portion. The guide rod engages in a positively locking manner into an opening at the lower end of the piston for locking the firing pin. An electrically operated motor/gearing unit can rotate the guide rod by a predetermined angle about its axis via two spur gears. Here, the Bowden cable is operated by the manual safety catch means (also on site), whereas the motor belongs to the remote-controlled (electrical) safety catch release means.

The mode of operation of this dual safety catch can be as follows:

If the safety catch of the weapon has for example been manually engaged, that part of the guide rod which is not bent out in a U-shape is situated within the opening at the lower end of the piston. If, in the manually safety catch-engaged state, safety catch release is to be performed via the remote-controlled unit, the guide rod rotates in the opening, but without raising the piston upwards into the position in which it releases the firing pin. The weapon remains with the safety catch engaged. Only through the manual safety catch release is the guide rod pulled with its U-shaped bulged portion into the opening of the piston by the Bowden cable, whereby the piston is raised and the safety catch of the weapon is disengaged.

If the safety catch of the weapon has been engaged by remote control, the angle of the guide rod is such that the piston cannot be raised—regardless of whether the safety catch of the weapon is manually engaged or released.

The guide rod produces a positively locking mechanical connection between the Bowden cable and the firing pin safety catch. Said positive guidance between the Bowden cable and the piston eliminates the possibility of the piston becoming jammed even though the cannon has been mechanically secured or the Bowden cable has been pulled. Again, firing is possible only when the safety catch of the firing pin has been both mechanically (for example locally) released and also electrically released by means of the remote control which activates the actuator.

A guide rod positively defines the position of the piston. In order that the piston can be placed into the safety catch release position, two conditions should be met: (1) the guide rod must be pulled such that the eccentric part lies below the piston (local—mechanical—safety catch release); and (2) the eccentric part of the guide rod must point upward (remote-controlled safety catch release).

The (local—on site) safety catch release is performed via the Bowden cable. Remote-controlled safety catch release is performed by virtue of the motor rotating the eccentric shaft by a suitable angle via a planetary gear set and via two spur gears.

The illustrated embodiment is also of particularly safe configuration. If the terminal voltage at the motor drops, whether as a result of an intentional control signal or owing to a power failure, the guide rod/eccentric shaft is placed automatically into the original position by two preloaded torsion springs (fail-safe). If one torsion spring fails, the preload of the other torsion spring is sufficient to engage the safety catch of the cannon. However, the failure of the torsion spring must be identifiable in order that it can be replaced. If the Bowden cable snaps, the guide rod is pushed forward by the pressure spring and the safety catch of the cannon is engaged.

In a refinement of the concept, the remote-operable firing pin safety catch also has inputs for other safety signals already available at the gun (for example emergency stop, emergency off, fire enable, man aloft, etc.). In this way, it is achieved that safety is established even if the actuation of the local control element for preventing remote-controlled safety catch release is forgotten. At the same time, all safety-relevant functions are configured redundantly, for example in order to identify faults owing to leakage currents.

The end positions of the firing pin safety catch are preferably detected by means of sensors (safety catch engaged, safety catch released). If the input signals of the remote-operable firing pin safety catch are likewise detected, the correct functioning of the firing pin safety catch can be monitored by means of a simple logic arrangement (software or analog), whereby risk can again be eliminated.

Alternatively, the guide rod which is bent in a U-shape may be replaced with an eccentric shaft, against which the piston is pressed by spring force. An eccentric shaft defines the position of the piston. In order that the piston can be moved into the safety catch release position, two conditions should be met: (1) the Bowden cable must be pulled in order that the eccentric lies below the piston (local—mechanical—safety catch release); and (2) the eccentric part of the eccentric shaft must point upwards (remote-controlled safety catch release).

The manual, local safety catch release is performed via the Bowden cable. Remote-controlled safety catch release is performed by virtue of the motor rotating the eccentric shaft by a suitable angle via a planetary gear set and via two spur gears. If the terminal voltage at the motor drops, whether as a result of an intentional control signal or owing to a power failure, the eccentric shaft is placed automatically into the original position by two preloaded torsion springs (fail-safe). The following safety means ensure that the safety catch of the cannon is engaged in the event of failure of a component. If a torsion spring fails, the preload of the other torsion spring is sufficient to engage the safety catch of the cannon. However, the failure of the torsion spring must be identifiable in good time in order that it can be replaced. If the Bowden cable snaps, the eccentric shaft is pushed forward by the pressure spring and the safety catch of cannon is engaged.

The eccentric shaft can be composed of three portions:

The eccentric is situated in a first portion. The radius increases linearly with the angle (Archimedes spiral); here, the difference in radii corresponds to the stroke of the piston. For space reasons, the shaft may be mounted such that it rests on a spindle. For this purpose, a bore is formed on one end of the shaft.

In a second portion of the shaft, the radius is constant. It is possible for only either the first or the second portion to lie below the piston. The axial play is limited by the mounting. In order that the shaft can however assume only two positions in a stationary manner, the Bowden cable must, as before, be latched, otherwise the eccentric shaft is placed into the initial position by the pressure spring.

In the third portion, the shaft is mounted; the torque of the motor is transmitted here and the spring forces act here.

In order that the firing pin safety catch can be mechanically released even when the safety catch of the cannon has already been released by remote control, a flange is mounted between the first and second portions. Again, for space reasons, and since the eccentric shaft extends into the vicinity of the cradle, the gradient of the flange must not be too shallow, otherwise the eccentric shaft will be too long. However, too steep a gradient of the flange may have the result that the safety catch release of the cannon is possible only through the exertion of a considerable force. The axial switching travel of the eccentric shaft must be selected suitably for this purpose.

The firing pin safety catch of a gun can be released by remote control: as a result, the operation-ready (that is to say with safety catch manually released) gun can have the safety catch engaged until shortly before use, as a result of which safety is generally increased. Furthermore, safety is ensured in the event of work being performed locally on the gun (manual safety catch engagement on site). Correct functioning of the safety catch can be tested automatically and manually as required. The weapon achieves an additional safety level, which thus meets the simultaneous demands for safety and operability by the troops.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
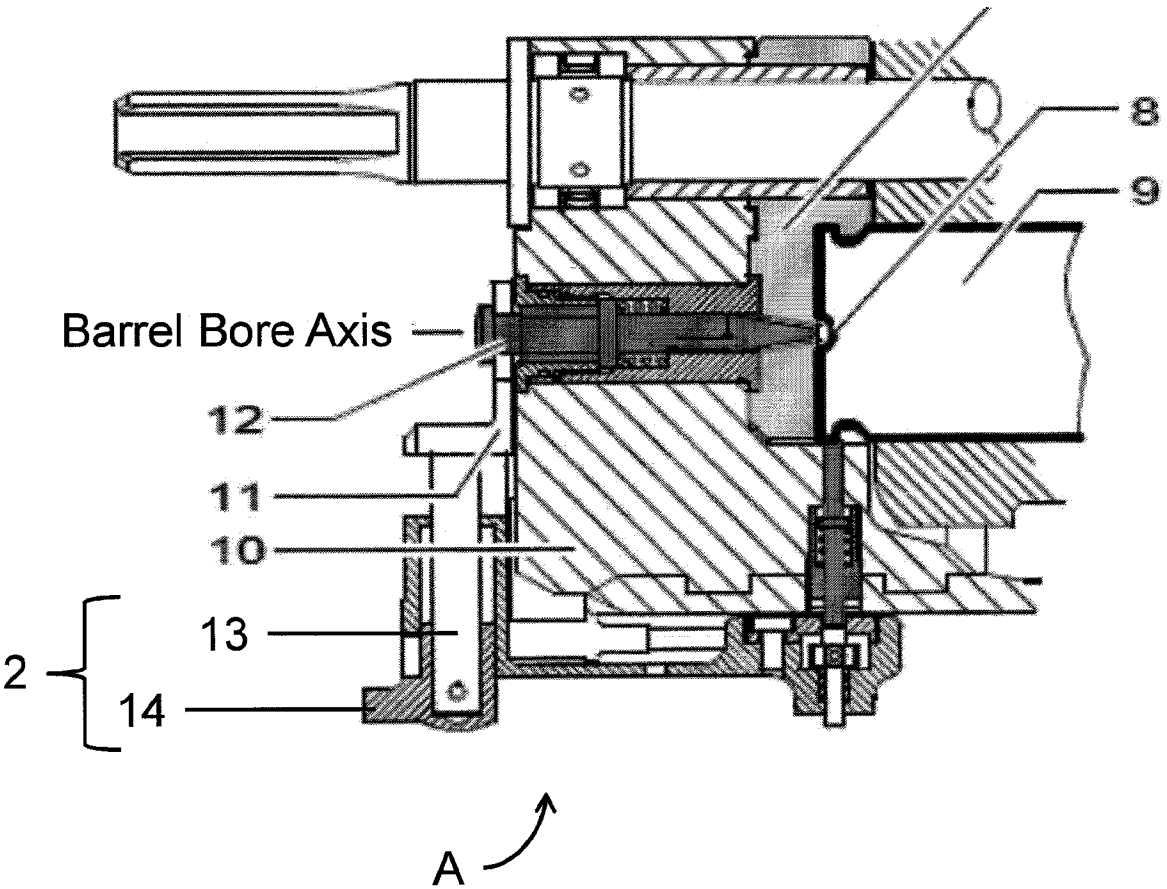
FIG. 1 shows an illustration of an installation of a firing pin and of a safety catch.

FIG. 1 shows an installed position of a firing pin 12 and of a firing pin safety catch 11, such as is known from the prior art. Here, the firing pin 12 is positioned, as an elongation of the barrel axis 14, so as to be located within a base piece 10 and in front of an ignition cap 8 of a cartridge 9. The firing pin 12 is mounted so as to be movable in the direction of the barrel axis and is secured by the firing pin safety catch 11. Here, the firing pin safety catch engages with an opening into the rear part of the firing pin 12. The firing pin safety catch 11 can be adjusted in height by means of a piston rod 13. If the firing pin safety catch 11 is adjusted by the piston rod 13, it releases the firing pin 12. The piston rod 13 is in turn a constituent part of a piston 14 and is moved by the piston 14 counter to a spring (not illustrated in any more detail).

Figure 2:
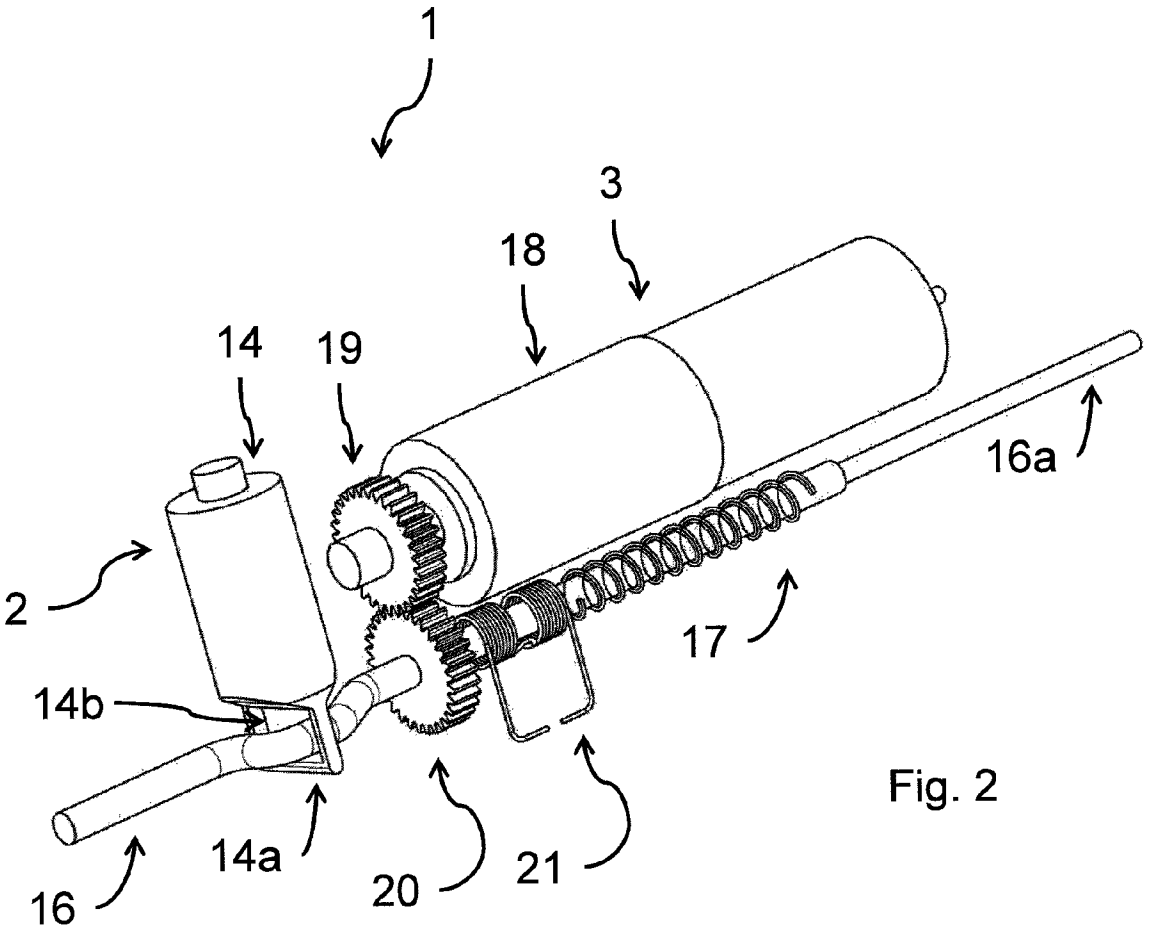
FIG. 2 shows a combined firing pin safety catch.

FIG. 2 shows a first variant of an inventive, that is to say combined firing pin safety catch 1, which can be incorporated approximately at a position indicated in FIG. 1 by A. The piston 14 of a mechanical firing pin safety catch 2 has, on its lower end 14*a*, an opening 14*b* through which is guided a guide rod 16 which is bent in a U-shape. The rod 16 is mounted so as to be movable along its longitudinal direction and can be displaced axially counter to a pressure spring 17 by means of a Bowden cable 16*a* which belongs to the manual safety catch device 2. An electrically operated motor/gearing unit 18 as part of an electrical (remote-operable) firing pin safety catch 3 drives the guide rod 16 of the mechanical firing pin safety catch 2, and sets said guide rod in rotation counter to the preload of a torsion spring 21, via two spur gears 19, 20. If the guide rod 16 is situated in an axial position in which the U-shaped bent-out portion is situated within the opening of the piston 14, then in the event of a rotation of the guide rod 16 generated by the remote-controlled motor/gearing unit 18, the piston 14 can be raised and the firing pin 12 released.

Figure 3:
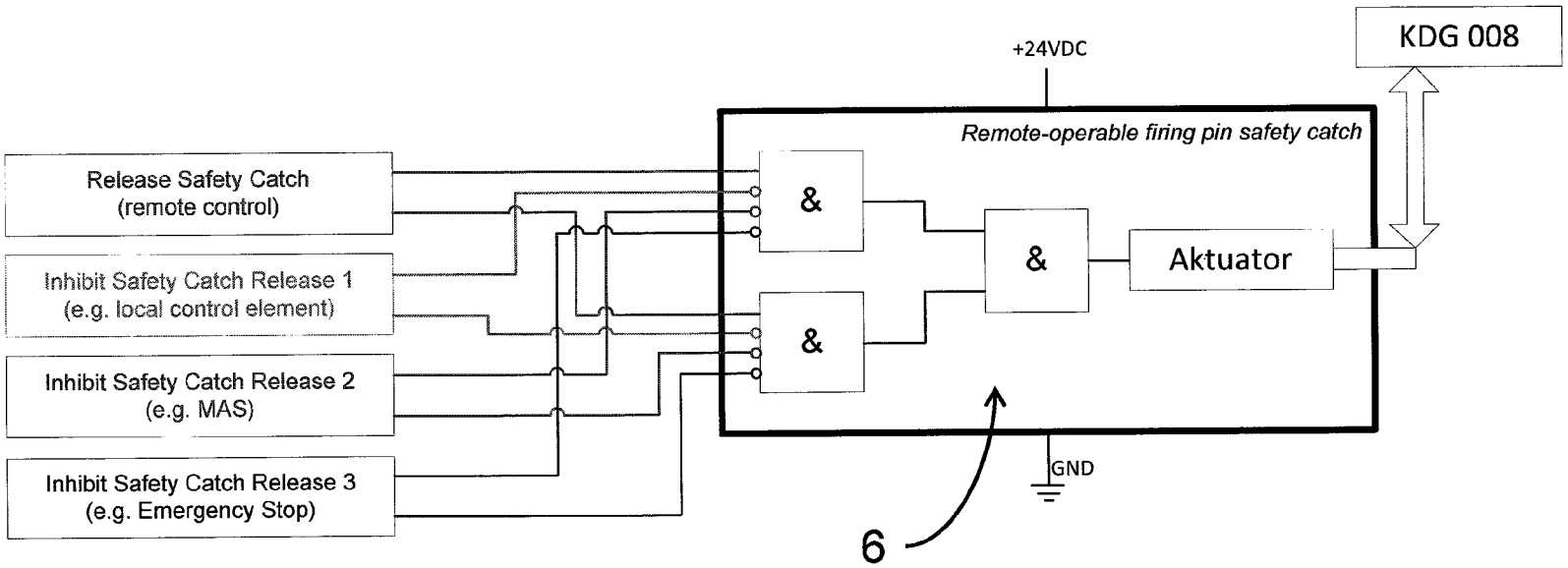
FIG. 3 shows an illustration of the circuit of the electrical firing pin safety catch.

The electrical circuit is realized in the simplest case (FIG. 3) by means of the signal of the remote controller (Release Safety Catch) and a signal of the manual safety catch release by means of a local control element (Inhibit Safety Catch Release). Both signals are conducted via an AND comparator (6) which transmits a control signal to the actuator of the remote-operable firing pin safety catch, as a result of which the safety catch of the weapon is ultimately released. To increase fail-safety, it is provided in a further embodiment that lines and the AND comparator are of duplex configuration. The two output signals of the comparators are again compared before the actuator is triggered.

In a further embodiment, additional signals are queried before the triggering of the actuator, for example a manual safety switch (MAS, man aloft switch) or an emergency stop (Emergency Stop).

Figure 4:
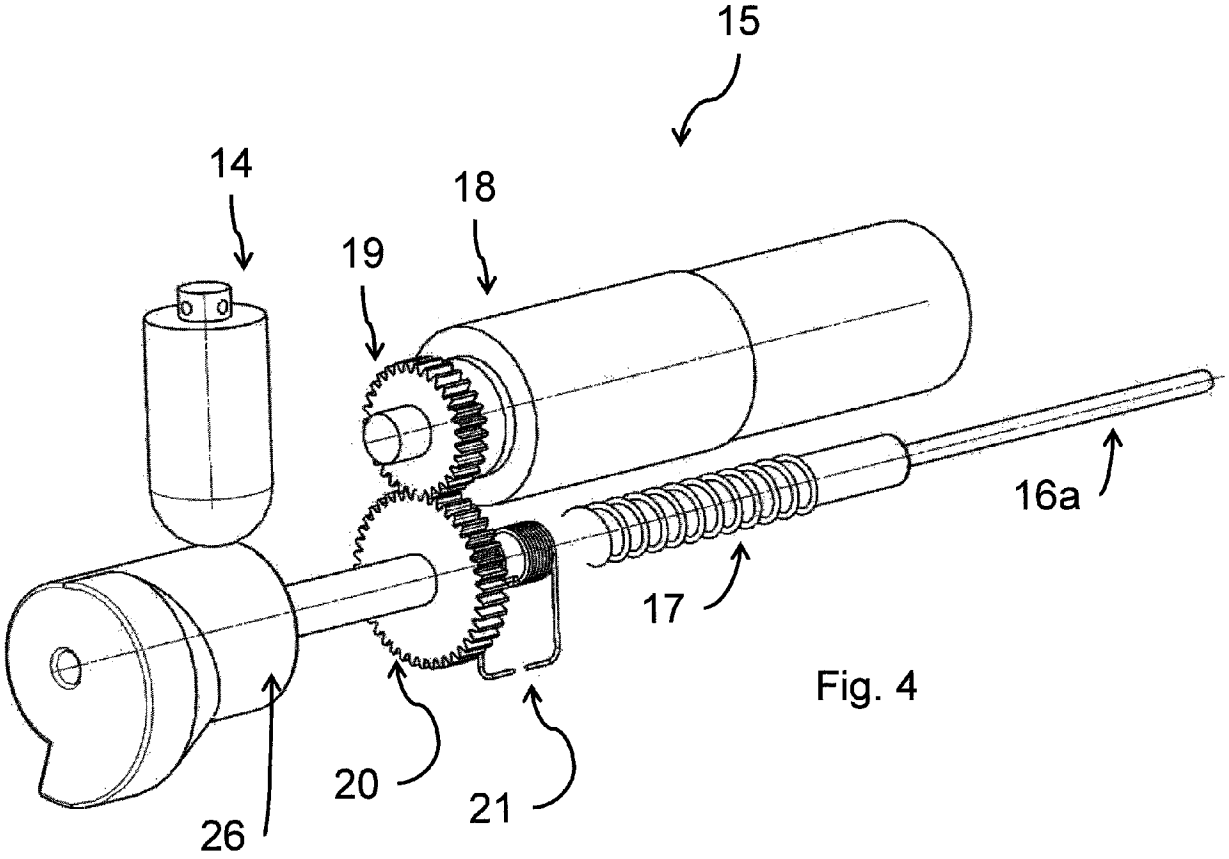
FIG. 4 shows a further embodiment of the combined firing pin safety catch.

FIG. 4 illustrates a further variant of a combined firing pin safety catch 15. The piston 14 is pressed against an eccentric shaft 26 by a spring (not illustrated). The eccentric shaft 26 is mounted so as to be movable along its axial direction. Said eccentric shaft can be displaced axially counter to the compression spring 17 by means of a Bowden cable 26*a* which belongs to the manual safety catch device. An electrically operated motor/gearing unit 18 drives the eccentric shaft 26, and sets the latter in rotation counter to the preload of the torsion spring 21, via two spur gears 19, 20. If the eccentric shaft 26 is situated in an axial position in which its radius is constant in relation to the piston 14 (safety catch manually engaged), then in the event of a rotation of the eccentric shaft 26 generated by the remote-controlled motor/gearing unit 18, the piston 14 cannot be raised and the safety catch of the firing pin 12 cannot be released.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A firing pin safety catch for a firing pin of an unmanned gun, wherein an electric actuator as an electrical firing pin safety catch is incorporated into a mechanical firing pin safety catch so that both firing pin safety catches form a uniform common firing pin safety catch, and wherein the mechanical firing pin safety catch comprises a piston which, at a lower end thereof, has an opening through which is guided a guide rod that is bent into a U-shape, and wherein the guide rod is mounted so as to be movable along its axial direction.

2. The firing pin safety catch as claimed in claim 1, wherein the guide rod is configured to be displaced axially counter to a pressure spring by a Bowden cable.

3. The firing pin safety catch as claimed in claim 2, wherein the guide rod produces a positively locking mechanical connection between the Bowden cable and the firing pin safety catch.

4. The firing pin safety catch as claimed in claim 1, wherein an electrically operated motor drives the guide rod of the mechanical firing pin safety catch via two spur gears.

5. The firing pin safety catch as claimed in claim 4, wherein the guide rod is set in rotation counter to the preload of a torsion spring when the guide rod is situated with the U-shaped bent-out portion within the opening of the piston such that as the guide rod rotates, the piston is raised and the safety catch of the firing pin is released.

6. A firing pin safety catch for a firing pin of an unmanned gun, wherein an electric actuator as an electrical firing pin safety catch is incorporated into a mechanical firing pin safety catch so that both firing pin safety catches form a uniform common firing pin safety catch, and wherein the mechanical firing pin safety catch comprises a piston and an eccentric shaft, and wherein the piston is pressed against the eccentric shaft and the eccentric shaft is mounted so as to be movable along its axial direction.

7. The firing pin safety catch as claimed in claim 6, wherein the eccentric shaft comprises a first portion, in which the radius increases linearly with the angle, and a second portion, in which the radius is constant.

8. The firing pin safety catch as claimed in claim 6, wherein the eccentric shaft is configured to be displaced axially counter to a pressure spring by a Bowden cable.

9. The firing pin safety catch as claimed in claim 8, wherein a motor drives, and sets in rotation, the eccentric shaft of the mechanical firing pin safety catch via two spur gears.

10. The firing pin safety catch as claimed in claim 9, wherein, upon a rotation of the eccentric shaft generated by the motor, the piston cannot be raised, and the safety catch of the firing pin cannot be released when the radius of the eccentric shaft is constant in relation to the piston and the safety catch is thus manually engaged.

11. The firing pin safety catch as claimed in claim 4, wherein, in the event of a drop in the terminal voltage at the motor, the guide rod is placed automatically into the original position by two preloaded torsion springs.

12. The firing pin safety catch as claimed in claim 11, wherein, in the event of failure of one torsion spring, the preload of the other torsion spring is adequate to engage the safety catch of the gun.

13. The firing pin safety catch as claimed in claim 11, wherein, in the event of snapping of the Bowden cable, the guide rod or the eccentric shaft is pushed forwards by the pressure spring and the safety catch of the gun is engaged.

14. A method for firing a pin safety catch engagement the pin safety catch engagement for a firing pin of an unmanned gun, wherein an electric actuator as an electrical firing in safety catch is incorporated into a mechanical firing pin safety catch so that both firing pin safety catches form a uniform common firing pin safety catch, wherein an electric circuit takes place by a signal of a remote controller and a signal of the mechanical safety catch release by a local control element, and wherein both signals are conducted via an AND comparator which transmits a control signal to the actuator of the remote-operable or electrical firing pin safety catch, and wherein firing is possible only when the safety catch of the firing pin has been both mechanically and also electrically released by the uniform firing pin safety catch, for which purpose the two output signals of the comparators are compared before the actuator is triggered.

15. The firing pin safety catch as claimed in claim 9, wherein, in the event of a drop in the terminal voltage at the motor, the eccentric shaft is placed automatically into the original position by two preloaded torsion springs.

16. A firing pin safety catch for a firing pin of an unmanned gun, comprising:

a guide rod, wherein the guide rod is manually displaceable in an axial direction between a first axial position and a second axial position, wherein the guide rod is rotatable by control of a remotely operated electrical motor gearing unit between a first rotation position and a second rotation position, and wherein the firing pin safety catch is in a released state only when the guide rod is in the second axial position and the second rotation position.

17. A remotely-operable firing pin safety catch for a firing pin of an unmanned gun, wherein an electric actuator as an electrical firing pin safety catch is incorporated into a mechanical firing pin safety catch so that both firing pin safety catches form a uniform common firing pin safety catch, and wherein the mechanical firing pin safety catch comprises a piston and a piston rod, the mechanical firing pin safety catch being height-adjustable by the piston rod.

18. The remotely-operable firing pin safety catch according to claim 17, wherein a sequence for arming the unmanned gun using the mechanical firing pin safety catch and the electrical firing pin safety catch is arbitrary.

* * * * *